United States Patent [19]

Bertram et al.

[11] Patent Number: 4,601,597

[45] Date of Patent: Jul. 22, 1986

[54] APPLICATOR FOR HOT-MELT ADHESIVE

[75] Inventors: Wilhelm Bertram; Alfred Böttcher; Carl Siegmann, all of Bremen, Fed. Rep. of Germany

[73] Assignee: Heinrich Buhnen KG, Bremen, Fed. Rep. of Germany

[21] Appl. No.: 608,860

[22] Filed: May 10, 1984

[30] Foreign Application Priority Data

May 11, 1983 [DE] Fed. Rep. of Germany ..... 3317135

[51] Int. Cl.[4] ..... B67D 5/62

[52] U.S. Cl. ..... 401/1; 401/2; 222/146.1; 222/146.5

[58] Field of Search ..... 401/1, 2; 222/146.1, 222/146.5

[56] References Cited

U.S. PATENT DOCUMENTS

| | | | |
|---|---|---|---|
| 3,877,610 | 4/1975 | Dickey | 222/146.5 |
| 4,026,440 | 5/1977 | Crum et al. | 222/146.1 |
| 4,150,770 | 4/1979 | Wieland, Jr. et al. | 222/146.5 |

*Primary Examiner*—Vincent Millin
*Assistant Examiner*—Alfedo Acoff
*Attorney, Agent, or Firm*—Frost & Jacobs

[57] ABSTRACT

A hot-melt adhesive applicator with a heating block features a flow maze for the hot-melt adhesive, arranged between heating block and applicator nozzle, which is formed, for one, by parts of the heating block, and, for another, by a detachable maze attachment, and causes the hot-melt adhesive to flow through thin ribbon or disk-shaped spaces in intimate contact with heated surfaces, with all essential adhesive channels being easily accessible for cleaning upon removal of the maze attachment.

11 Claims, 7 Drawing Figures

APPLICATOR FOR HOT-MELT ADHESIVE

BACKGROUND OF THE INVENTION

The invention concerns an applicator for a hot-melt adhesive comprising a tank for the adhesive, a heating block bordering on the tank, and means for forcing adhesive melted in the tank through an applicator nozzle. Utility melting apparatuses of this type are frequently used in areas where varying adhesive quantities must be dispensed.

At the same time it must be assured that the temperature of the adhesive leaving the applicator nozzle remains extensively constant and independent of whether the adhesive throughput is large or small quantities. In addition, a minimization of the heatup time of the apparatus after longer periods of nonuse is being sought in order to keep time losses corresponding small.

Various suggestions have been made toward meeting these requirements, but all of them leave things to be desired. One of these prior suggestions provides for an element which is connected with the heating block, possesses a great mass and surface and extends into the tank interior. The disadvantage of this solution, among other things, is the corresponding reduction of usable tank volume.

SUMMARY OF THE INVENTION

The problem underlying the invention is to so advance a hot-melt adhesive applicator in the sense of the above requirements that the temperatures of the adhesive can be held as constant as possible at large and small throughputs.

Based on a hot-melt adhesive applicator with an adhesive tank, a heating block bordering on the latter, and means for forcing adhesive melted in the tank through an applicator nozzle, the inventional solution to this problem consists in passing the adhesive on the way between the heating block and the applicator nozzle through a maze of successive, axially thin disk-shaped and/or radially thin ribbon-shaped annular channels whose walls are heated by the heating block as well as partly formed by parts of the heating block and otherwise by a maze attachment which is detachably connected with the heating block.

Preferred embodiments of this solution are set forth in the subclaims.

The goal set is being accomplished in that the adhesive must negotiate a long heated path in the form of thin ribbons or channels, remaining in intimate contact with heated surfaces until it finally leaves the applicator nozzle. Significant for this solution is that the mass of the heated walls and its supports may remain small, favoring not only the weight of the applicator but also a quick heating and, moreover, enabling a more sensitive regulation of the temperature. It is also a very important advantage to easily clean the comparatively thin channels. This advantage derives from forming all essential parts of the maze, on the one hand, by the one part, namely the maze attachment, and, on the other hand, by the other maze component, namely the end face of the heating block, so that the two maze components will be exposed for cleaning upon their separation.

BRIEF DESCRIPTION OF THE DRAWINGS

The invention will be more fully explained hereafter with the aid of the preferred embodiment illustrated in the drawing. The drawing shows in FIG. 1, a longitudinal cross-sectional view of a hot-melt adhesive applicator.

DESCRIPTION OF THE PREFERRED EMBODIMENTS

Figure 1:
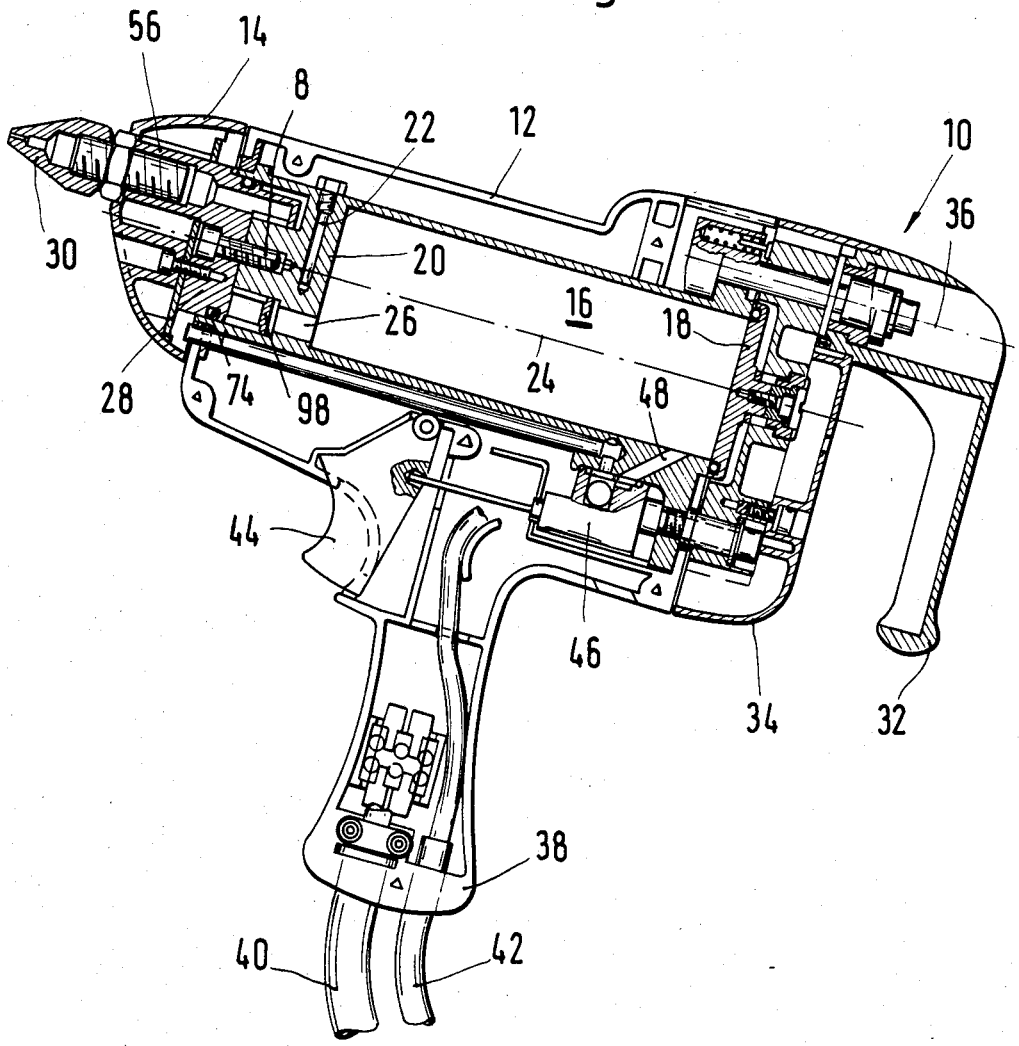

FIG. 1 shows an applicator 10 with a heatable adhesive tank 16 which on its one end can be sealed by a cover 18 and features on its other end a heating block 20. A thermosensor 22 is installed in the heating block, making it possible to hold the temperature of the heating block at a desire level. Offset relative to a center axis 24, a channel 26 extends through the heating block 20 and to a maze attachment 28 which hereafter will yet be described in detail, and finally to an applicator nozzle 30 from which the melted adhesive is ejected.

The tank 16 and the heating block 20 are surrounded by an applicator housing 12 composed of two half shells. Located before the end face of the applicator housing is a cap 14 which seals the housing up front and through which extends the applicator nozzle 30, according to FIG. 1.

Serving to open and close the tank cover 18 is a handle 32 upon release of which the rear wall 34 of the applicator 10 including the cover 18 can be screwed about an axis 36 which is parallel with the center axis 24.

Integrated with the applicator housing 12, additionally, is a pistol type grip 38 through which a power supply cable 40 and a compressed air line 42 enter the housing. A customary trigger 44 controls by means of a valve 46 the compressed air supplied to the tank 16.

Figure 7:
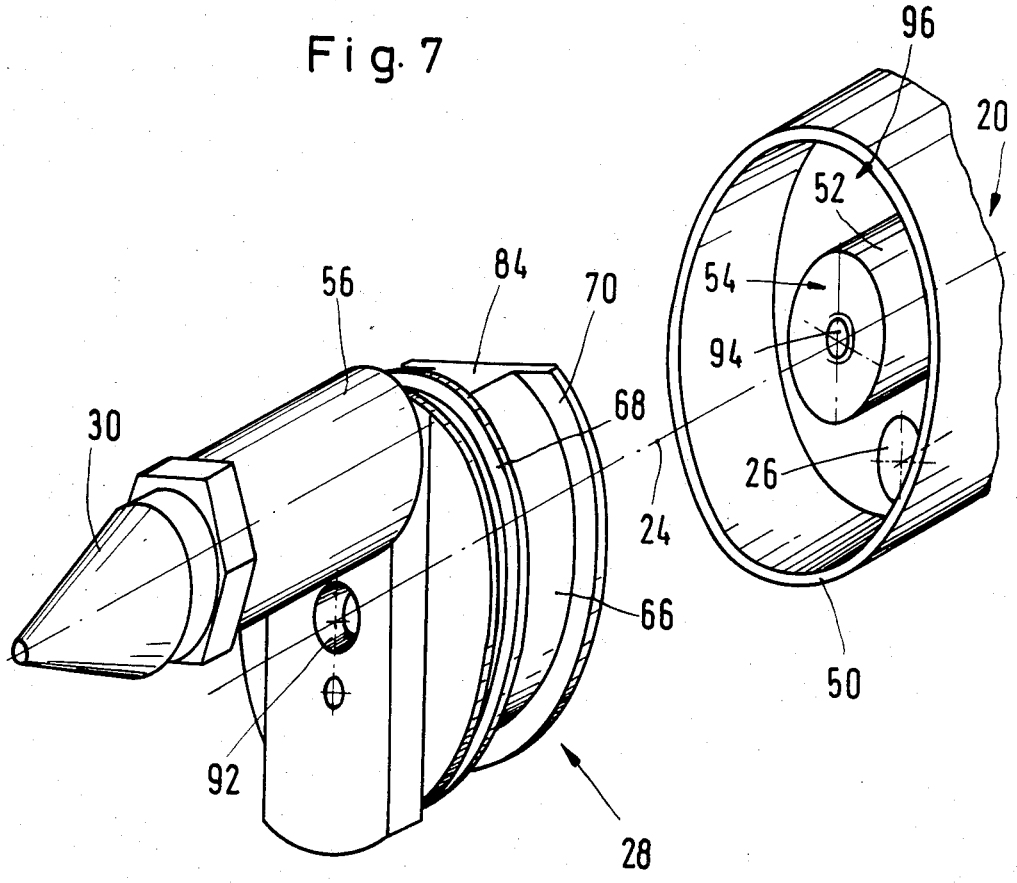

From FIGS. 1 and 7 it can be seen that the heating block 20 has a recess machined into its exposed end face forming a comparatively thin cylindrical outside wall 50 and, coaxial with it, an inside projection 52. The two figures show also that the end face 54 of the projection 52 is situated in a plane farther back toward the tank 16 and parallel with the plane extending through the end face of the heating element 20.

The maze attachment 28 consists basically of a cylindrical disk with various recesses and an extension 56 with a threaded bore 58 for receiving the applicator nozzle 30. The axis 60 of the threaded bore 58 extends parallel with the axis 24, which is not only the center axis of the tank 16 but likewise the center axis of the heating block 20 and that of the maze attachment 28.

The disk which essentially forms the maze attachment 28 has a rear surface 62 facing toward the heating block 20 and a front surface 64 from which originates the extension 56. Recessed into the circumference of the disk is an annular groove 66 which in axial direction is defined by two walls 68,70. The diameter of the walls 68,70 equal that of the disk and/or the maze attachment 28 as well as the inside diameter of the ring-shaped outside edge wall 50 of the heating block 20, as can be seen from FIG. 1.

Figure 5:
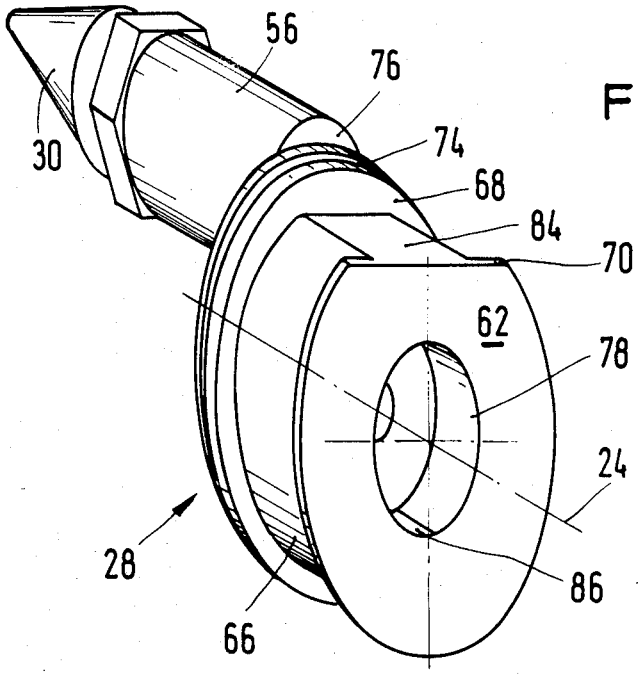
FIGS. 5 and 6, two perspective views of the maze attachment from different directions, and FIG. 7, an exploded perspective view of the maze attachment and the heating block for the hot-melt adhesive.

Between the annular groove 66 and the extension 56 of the maze attachment 28, in the circumference of the latter, there is recessed another annular groove 72 serving to receive and O-ring 74 (FIGS. 1 and 5). According to FIGS. 5 and 7, the backside 76 of the extension 56 protrudes somewhat beyond the diameter of the walls 68,70, that is, beyond the disk diameter.

Figure 2:
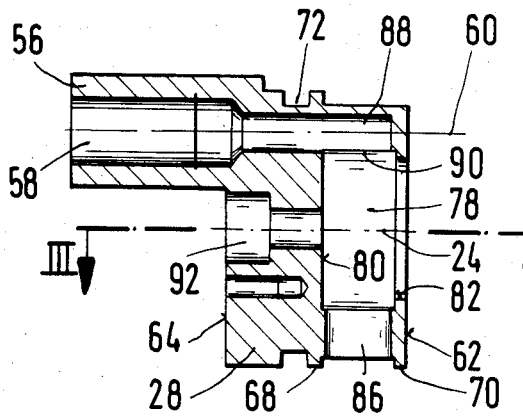
FIG. 2, an enlarged cross-sectional view through the maze attachment as illustrated in FIG. 1.
Figure 3:
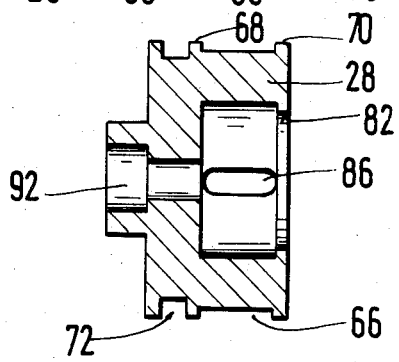
FIG. 3, a cross-sectional along line III-III of FIG. 2.
Figure 6:
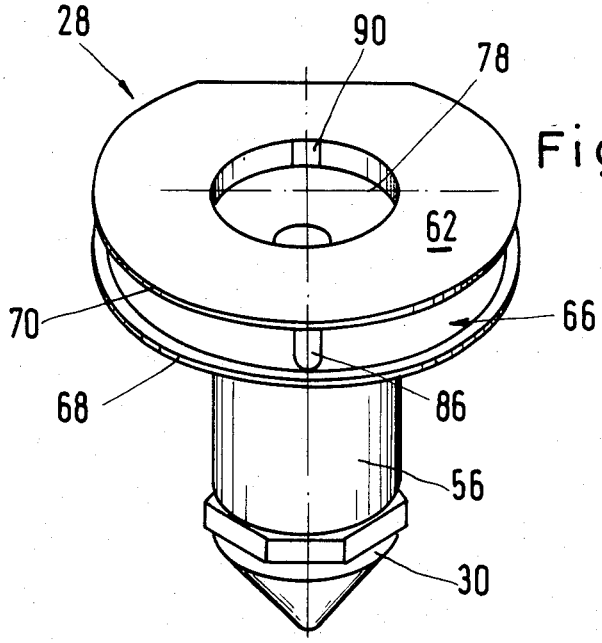

Inside the maze attachment 28 is a recess 78 which is open toward the rear surface 62. The recess 78 has a cylindrical circumference and is defined on its inside by an interior front wall 80 which is parallel with the rear surface 62. FIGS. 2, 3 and 6 depict well that the recess 78, from the front wall 80 and shortly before reaching the rear surface 62, has a diameter somewhat larger than that of the passage 82 to the rear surface 62. The diameter of this passage 82 equals the outside diameter of the projection 52.

Figure 4:
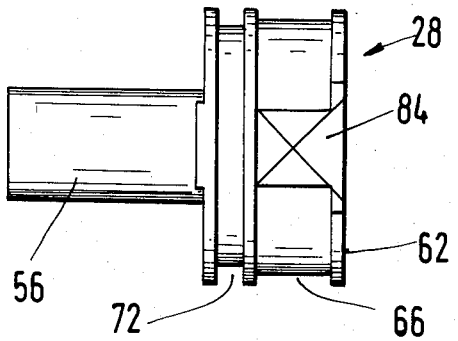
FIG. 4, a plan view of the maze attachment according to FIG. 2.

The maze attachment 28 features on its outside circumference a flat 84 which can be seen well from FIGS. 4, 5 and 7 and whose smallest radial spacing from the center axis 24 is smaller than the radius of the bottom of the annular groove 66 (compare FIG. 5). This flat extends in axial direction from the rear surface 62 up to immediately before the wall 68 of the annular groove 66.

The circular groove 66 connects, by way of an oblong hole 86 (solid black in FIG. 5), with the recess 78 inside the maze attachment 28. Diametrically opposed to the oblong hole 86, a channel 88 extending along the axis 60 of the extension 56 passes through the circumference of the recess 78, providing a transition 90 between the channel 88 and the recess 78 which is clearly visible in FIG. 6. Also, the channel 88 terminates before the rear surface 62 of the maze attachment 28.

With the dimensions described and deriving from the drawing, specifically FIG. 1, the maze attachment 28 fits into the recess on the exposed end of the heating block 20. The maze attachment 28 can be inserted into this recess until the front face 54 of the projection 52 of the heating block 20 makes contact with the end face 80 of the recess 78 of the maze attachment 28. As a result, the peripheral inside surface on the front end of the heating block covers, FIG. 1 the annular groove 66 of the maze attachment 28, and is sealed against the attachment by means of the O-ring 74, and terminates with its free front face immediately before the back side 76 of the extension 56 for the applicator nozzle 30.

The maze attachment 28 inserted in the heating block recess is secured on the applicator with the aid of a screw 8 (FIG. 1). The screw 8 in the center axis 24, passes through a bore 92 of the maze attachment 28 and is screwed into a threaded bore 94 which is contained centrally in the projection 52 of the heating block 20.

In operation, the hot-melt adhesive contained in the tank 16 is melted by the heat given off directly by the heating block 20 and through the walls of the tank. When now pulling the trigger 44 on the applicator grip 38, compressed air proceeds from the compressed air line 42 through the valve 46 and a channel 48 into the interior of the tank 16. The air forces the liquid adhesive into the channel 26 which is provided in the heating block 20, and the adhesive proceeds into an axially narrow annular space 98 which, in axial direction, is defined by the inside surface 96 of the front recess in the heating block 20 and the slightly spaced rear surface (62) of the maze attachment 28, and in radial direction by the circumference of the projection 52 and the inside of the outside wall 50. The adhesive flows into the annular space 98, from below (FIG. 1) and around the projection 52 on both sides, upward, and is thus in contact with the heated metallic heating block on the one side and with the metallic maze attachment 28 on the other side. Arriving at the top, the adhesive flows over the flat 84 on the circumference of the maze attachment 28 into the annular groove 66, which together with the outside wall 50 of the heating block 20 forms a shallow annular channel in which the adhesive now flows clockwise and counterwise down again. At the bottom end of the annular groove 66, the adhesive proceeds then through the oblong hole 86 into another annular channel within the recess 78. The annular channel contained therein is defined in radial direction, outwardly, by the cylindrical inside wall of the recess 78 and, inwardly, by the cylindrical circumference of the projection 52 of the heating block 20. The radial depth of the annular channel is small and is defined by the difference between the diameter of the passage 82 (the outside diameter of the projection 52) and the slightly large inside diameter of the recess 78.

The adhesive proceeding through the oblong hole 86 into the second annular channel formed in the recess 78 flows again clockwise and counterclockwise around the part of the projection 52 located there, upward, and proceeds then through the transition 90 (FIG. 6) into the channel 88 and on into the applicator nozzle 30.

Consequently, the maze consists essentially of the thin disk-shaped annular space 98, the ribbon-shaped annular space in the area of the annular groove 66, and the following ribbon-shaped annular space within the recess 78. The adhesive travels a comparatively long distance between the tank 16 and the applicator nozzle 30, and since the major part of the maze has a very large surface area combined with a slight thickness, practically all of the adhesive comes in intimate contact with heated metallic walls ensuring a good heating.

Of considerable practical significance is that all parts of the maze are very easily accessible for cleaning upon loosing the screw 8 and removal of the maze attachment 28.

Alternatively, the maze may be formed by the outside wall 50 and a plurality of radial, deep recesses in the periphery of the maze attachment, with successive disk walls featuring on diametrically opposed points passage openings or flats on the pheriphery for passing the adhesive from one disk-shaped radial annular space into the next. Instead of such recesses, of course, spaced disks may as well be slipped on a centering stud of the maze attachment, the outer circumference of the disks equaling the inside diameter of the outside wall 50.

We claim:

1. An applicator for a hot-melt adhesive, comprising:

a tank for the adhesive;

a heating block bordering on said tank;

a nozzle;

a maze attachment detachably connected with said heating block and fluidly connected to said nozzle, and including a maze of successive thin ribbon-shaped annular channels extending about at least a portion of said heating block and fluidly communicating with one another, formed by said heating block and said maze attachment when connected;

an axial channel through said heating block extending from said tank to said maze;

and means for forcing the molten adhesive in said tank through said axial channel, through said maze and through said nozzle.

2. An applicator according to claim 1, wherein said heating block includes a recess surrounded by an outside wall and also includes in said recess a cylindrical projection coaxial with said outside wall, said maze attachment including a cavity sized to receive said cylindrical projection and to form a first of said thin ribbon-shaped annular channels between said cylindrical projection and said cavity when said maze attachment is inserted in said recess of said heating block.

3. An applicator according to claim 2, wherein said maze attachment includes a cylindrical outer surface, said heating block recess being cylindrical in shape, said outer surface of said maze attachment having a diameter substantially equal to the diameter of said cylindrical recess of said heating block so that said maze attachment extends within said cylindrical heating block recess simultaneously as said heating block cylindrical projection extends within said maze attachment cavity when said heating block and said maze attachment are connected.

4. An applicator according to claim 3, further comprising an annular groove with a large width-to-depth ratio recessed in said outer surface of said maze attachment, said annular groove forming together with said outside wall of said heating block a second of said thin ribbon-shaped annular channels.

5. An applicator according to claim 4, wherein said maze attachment includes a rear wall into which said cavity extends, and said heating block cylindrical recess includes an inside surface from which said cylindrical projection extends so that when said maze attachment is installed within said heating block cylindrical recess said maze attachment rear wall is slightly axially spaced from said heating block inside surface forming a third thin ribbon-shaped annular channel about said cylindrical projection, said axial channel being in communication with said tank and said third annular channel of said maze.

6. An applicator according to claim 5, wherein said maze attachment annular groove includes a flat serving to connect said third annular channel with said second annular channel.

7. An applicator according to claim 5, wherein said maze attachment cavity has a first diameter portion adjacent said rear wall equal to said outside diameter of said cylindrical projection of said heating block and the remaining part of said cavity comprising a second, enlarged diameter portion, said second enlarged diameter portion forming together with the circumference of said cylindrical projection said first annular channel.

8. An applicator according to claim 6, wherein said annular groove of said maze attachment includes at a point diametrically opposed from said flat an opening connecting said first annular channel with said second annular channel.

9. An applicator according to claim 8, wherein said cavity of said maze attachment includes an aperture diametrically opposed to said opening and in radial alignment with the center axis of said maze attachment, connecting said first annular channel to said nozzle.

10. An applicator according to claim 4, wherein said maze attachment includes another annular groove on said outer surface for receiving an O-ring which seals said maze attachment against said outside wall of said heating block.

11. An applicator according to claim 1, wherein said maze attachment includes a central bore and said heating block includes a central threaded bore in said cylindrical projection, and a screw located in said bores for holding and operatively connecting said maze attachment to said heating block.

* * * * *